US007533497B2

(12) United States Patent
Cloutier et al.

(10) Patent No.: US 7,533,497 B2
(45) Date of Patent: May 19, 2009

(54) SNUBBER SYSTEM FOR WINDOWS

(75) Inventors: Regis Cloutier, Levis (CA); Rejean Levesque, Pintendre (CA)

(73) Assignee: Dallaire Industries Ltd., Lévis, Quebec ( * ) Notice: Subject to any disclaimer, the term of this patent is extended or adjusted under 35 U.S.C. 154(b) by 0 days.

(21) Appl. No.: 11/456,274

(22) Filed: Jul. 10, 2006

(65) Prior Publication Data

US 2008/0005972 A1 Jan. 10, 2008

(51) Int. Cl.
*E05B 55/00* (2006.01)

(52) U.S. Cl. ..... 49/449; 49/183; 49/176

(58) Field of Classification Search ..... 49/449, 49/176, 182, 183, 181, 187, 394; 292/DIG. 20, 292/DIG. 47; 52/204.51
See application file for complete search history.

(56) References Cited

U.S. PATENT DOCUMENTS

| | | | | | |
|---|---|---|---|---|---|
| 415,668 | A | * | 11/1889 | Emery et al. | 49/449 |
| 473,137 | A | * | 4/1892 | Allbright | 292/342 |
| 1,061,569 | A | * | 5/1913 | Rullman | 292/87 |
| 1,250,816 | A | * | 12/1917 | Dunderdale | 49/225 |
| 1,928,734 | A | * | 10/1933 | Nelson | 292/60 |
| 4,525,952 | A | * | 7/1985 | Cunningham et al. | 49/449 |
| 4,683,676 | A | * | 8/1987 | Sterner, Jr. | 49/181 |
| 5,356,185 | A | * | 10/1994 | Cameron | 292/149 |
| 6,311,439 | B1 | | 11/2001 | Arcati | |
| 6,363,659 | B1 | * | 4/2002 | Wang | 49/183 |
| 2005/0155301 | A1 | | 7/2005 | Hapka et al. | |
| 2005/0166496 | A1 | | 8/2005 | Farag | |

* cited by examiner

*Primary Examiner*—Gregory J. Strimbu
(74) *Attorney, Agent, or Firm*—Curtis B. Behmann; Borden Ladner Gervais LLP

(57) ABSTRACT

A snubber for a window unit. The snubber includes a frame mount for securing to the frame of the window unit and a sash mount for securing to the sash of the window unit, proximate the frame mount. The frame mount and the sash mount have cooperating shapes for abutting against each other upon the window unit being closed and upon pressure being applied to the sash. The frame mount and the sash mount can be secured to the window unit on easily accessible parts of the window unit.

4 Claims, 6 Drawing Sheets

SNUBBER SYSTEM FOR WINDOWS

FIELD OF THE INVENTION

The present invention relates generally to the field of windows. More particularly, the present invention relates to a snubber system for securing pivotable windows to a window frame when subjected to strong winds.

BACKGROUND OF THE INVENTION

Hung windows are well known. Single hung windows have a window frame that comprises a fixed glass pane and a sash having a glass pane, the sash being vertically slidable within the window frame. Double hung windows have two sashes, each having a glass plane, which are vertically slidable within the window frame.

Also well known are pivotable hung windows. For these, fixtures at the bottom of a sash pivotally engage cooperating fixtures disposed in opposite vertical channels of the window frame. A releasable latch mechanism is disposed at the top part of the sash and allows a user to pivot the sash to the inside of the building in which the window is installed. These pivotable hung windows allow for easy cleaning of the exterior of the window pane from the inside of the building.

Additionally, hung windows usually include a lock mechanism for locking together the top and bottom windows in a closed position. In addition to providing security to the building, the lock mechanism provides additional structural strength to the window assembly. This added strength is desirable particularly in stormy weather where strong winds prevail. However, the additional structural strength is only present when the lock mechanism is engaged.

Hung window sashes made of materials such as PVC tend to bend under strong wind pressure, sometimes causing them to dislodge from the window frame. Additionally, the latch mechanisms of pivotable window sashes in general can fail in such weather conditions. Consequently, window sashes can abruptly open and cause damage to the window unit and to the building.

To address the problem of abruptly opening hung windows, several window brackets, or snubbers, for hung windows have been developed. One such type of bracket is disclosed in U.S. Pat. No. 6,363,659 to Wang. The bracket includes an L-shaped part (20) for securing to a vertical side of the window frame and a Z-shaped part (10) for securing to a corresponding vertical member of the window sash. The bracket L-shaped and Z-shaped parts are mounted hidden from sight on respective planes parallel to each other and perpendicular to the glass pane plane. The bracket parts are of cooperating shape such that when mounted and with the window closed, the brackets parts overlap and interlock to prevent pivoting of the window sash. This type of bracket can be adequate for windows framed in aluminum or wood where bending under pressure is not considerable, but inadequate for PVC window units. The bending of PVC in strong winds is such that the interlocking mechanism of the L-shaped bracket and the Z-shaped bracket can fail and the hung window pop open.

Additionally, the Wang bracket parts are not easy to install. Installation of the bracket parts requires that the window sash be pivoted in the open position. Further, the Z-shaped part requires that a worker have access to each side of sash. This can be impossible in cases where the window unit is installed close to an interior perpendicular wall of the building. In such cases, the window sash has to be removed from the window frame to install the part. Furthermore, the Z-shaped part includes parallel, spaced-apart, segments that are for abutting to parts of the window sash. These bracket features have to match the dimensions and the features of the window sash. As such, a given Wang bracket is not adapted to fit to window sashes of different dimensions.

Another type of bracket for providing impact resistant window units is disclosed in U.S. Patent Application Publication No. 2005/0155301A1 to Hapka et al., hereinafter referred to as Hapka. The Hapka bracket is fitted in the frame of the window unit, on the inside of the building. The bracket includes a movable bracket portion which can be in an extended or retracted position, overlapping the window sash in the extended position. When in the extended position, the movable bracket portion abuts the window sash thereby providing additional structural force to the window sash in strong wind conditions. When in the retracted position, the movable bracket portion allows a pivotable window sash to pivot for cleaning. However, the Hapka bracket requires significant work for retrofitting in existing windows.

Consequently, there is a need in the pivotable hung window art for an affordable bracket, or snubber, system that can be easily retrofitted to existing windows and that provides additional structural strength to window unit to sustain strong winds.

SUMMARY OF THE INVENTION

It is an object of the present invention to obviate or mitigate at least one disadvantage of previous window snubber systems.

In a first aspect, the present invention provides a snubber system for a window unit mountable to a building, the window unit having a frame with a frame member and a window sash with a sash member, the sash member being substantially parallel to the frame member and being proximate the frame member. The snubber system comprises a frame mount for mounting to the frame member. The snubber system further comprises a sash mount for mounting to the sash member, on a surface of the sash member facing an outside of the building, the frame mount and the sash mount having cooperating shapes for abutting against each other when the window sash is in a closed position and when pressure is applied to the window sash.

The frame mount can include a straight segment and a folded segment, the straight segment for securing to the frame member when the window unit is in a closed position.

The sash mount can include a straight segment and a folded segment, the straight segment for securing to the sash member when the window unit is in a closed position.

The frame mount can be mounted to the frame member on a mounting part of the frame member disposed outside the building.

The mounting part of the frame member can define a plane substantially perpendicular to a plane defined by a glass pane of the window sash.

The sash mount can be mounted to the sash member on a mounting surface of the sash member substantially parallel to a plane defined by a glass pane of the window sash.

The frame mount can define a hole, or aperture, for receiving a fastener for fastening the frame mount to the frame member and the sash mount can define a hole, or aperture, for receiving a fastener for fastening the sash mount to the sash member.

The frame mount and the sash mounts can include folded segments for abutting against each other.

The folded segments can include hook segments and the cooperating shapes can include interlocking shapes.

The snubber system can further comprise a snubber profile allowing a full amplitude of movement of the window sash.

In a further aspect, there is provided a pivotable sash window unit comprising a snubber frame mount for mounting to a frame of the window unit and a snubber sash mount for mounting to a sash of the window unit. The snubber sash mount is for mounting proximate the snubber frame mount, on a surface of the sash facing an outside of a building receiving the window unit. The snubber frame mount and the snubber sash mount have cooperating shapes for abutting against each other when the window is in a closed position and when pressure is applied to the sash.

In a further aspect of the invention, there is provided a snubber system for a window unit mountable to a building, the window unit having a frame with substantially vertical frame members and a window sash with substantially vertical sash members. The snubber system comprises a frame mount for mounting to one of the substantially vertical frame members and a sash mount for mounting to one of the substantially vertical sash members on a surface of the substantially vertical sash member facing an outside of the building. The frame mount and the sash mount have cooperating shapes for abutting against each other when the window unit is a closed position and when pressure is applied to the window sash.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

For the purpose of this document, a sash is a part of a window unit movable within the frame of the window unit, and the term window unit includes window-door units such as, for example, sliding patio doors.

Generally, the present invention provides a snubber system for securing window units subjected to strong winds. The snubber system includes two cooperating parts that can easily be retrofitted to most window units. The snubber system includes a frame mount secured to the window frame and a sash mount secured to a window sash of the window unit on a part of the sash facing the outside of the building receiving the window unit. The frame mount and sash mount abut each other when the window is in a closed position and when pressure is applied to the window sash.

Figure 1:
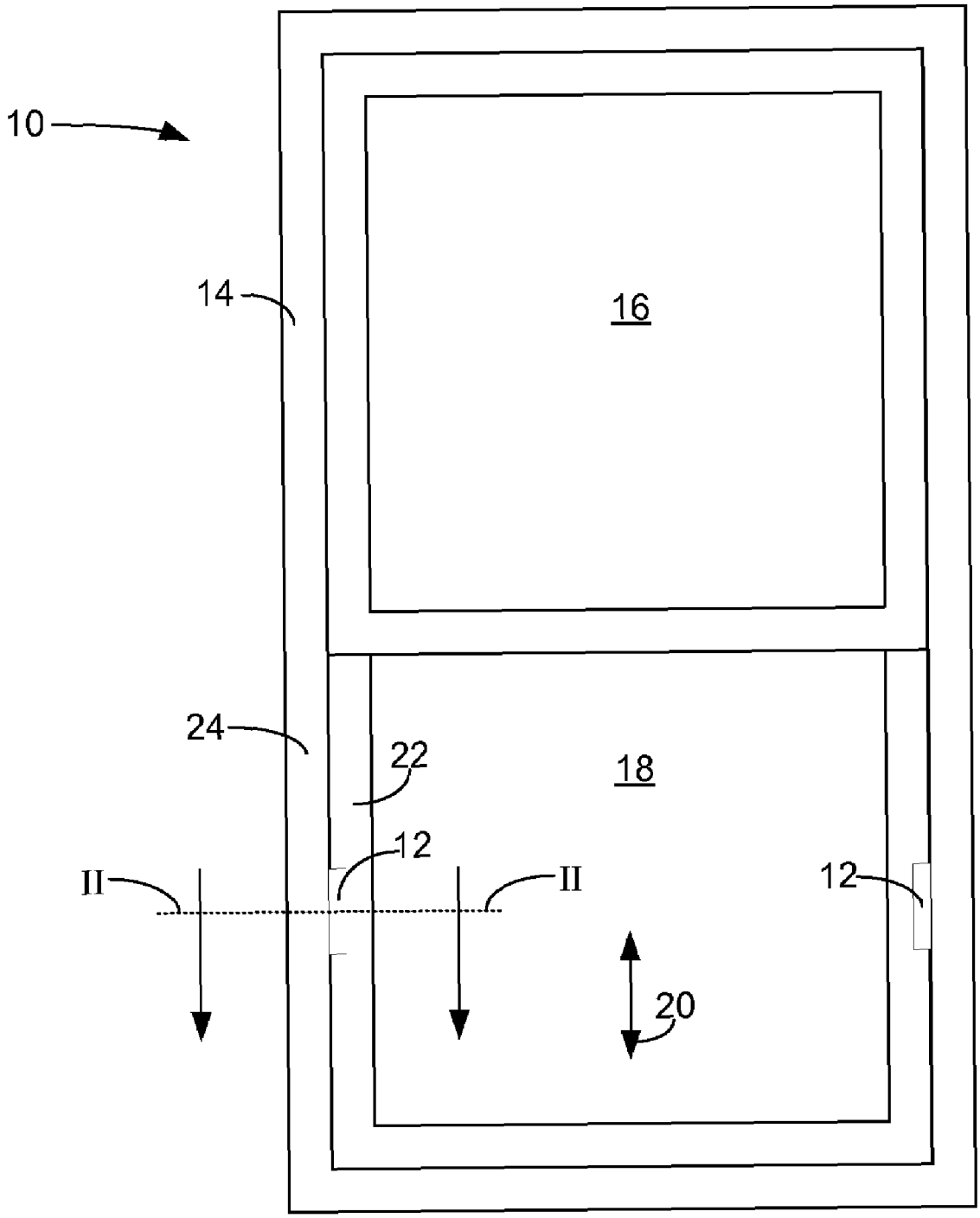
FIG. 1 is a frontal view of a single hung window unit fitted with two snubber systems of an embodiment of the present invention.
Figure 2:
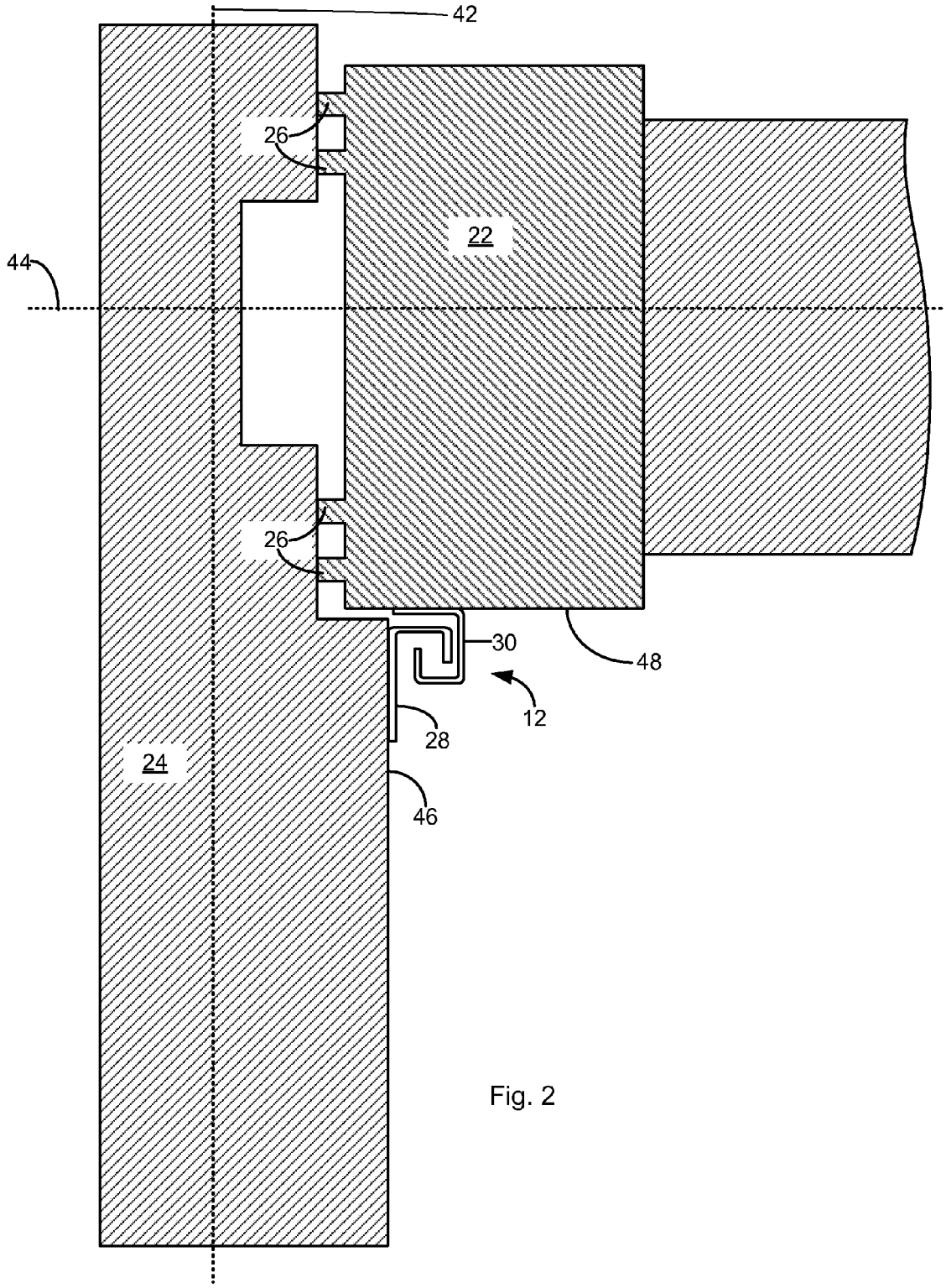
FIG. 2 is a cross-sectional view of the window unit of FIG. 1, showing an embodiment of the snubber system of the present invention.

FIG. 1 shows an exterior view of a single hung window unit 10 equipped with a snubber system 12 of the present invention. The window unit 10 includes a frame 14, an upper window 16 fixedly secured to the frame 14 and a pivotable window sash 18 slidably engaging the frame and movable along the directions indicated by the double arrow 20. The snubber system 12 has elements mounted to both a sash member 22 and a window frame member 24. FIG. 2 shows a cross-sectional view of the window unit 10 taken along the line II-II of FIG. 1.

In FIG. 2, the sash member 22 engages the window frame member 24 via weather stripping members 26. An embodiment of the snubber system 12 is shown in FIG. 2 and includes a frame mount 28 and a sash mount 30 respectively secured to the frame member 24 and the sash member 22 by any suitable fasteners such as, for example, screws, or by any other suitable securing means such as, for example, epoxy or glue.

As an example, the frame mount 28 is shown secured to the frame 24 in a plane substantially parallel to a frame plane 42, which is substantially perpendicular to a window plane 44. The sash mount 30 is shown secured to the sash member 22 in a plane substantially parallel to the window plane 44. The frame mount 28 can be mounted to an inner part 46 of the frame member 24 and the sash mount 30 can be mounted to an exterior part 48 of the sash member 22, the exterior part 48 facing an outside of the building in which the window is installed. The orthogonality of the planes to which the frame mount 28 and the sash mount 30 are secured, as shown in FIG. 2, is not essential to the present invention. That is, the surface of the inner part 46 of the frame member 24 need not be parallel to the frame plane 42 and the surface of the exterior part 48 of the sash member 22 need not be parallel to the window plane 44.

Figures 3A, 3B, 3C:
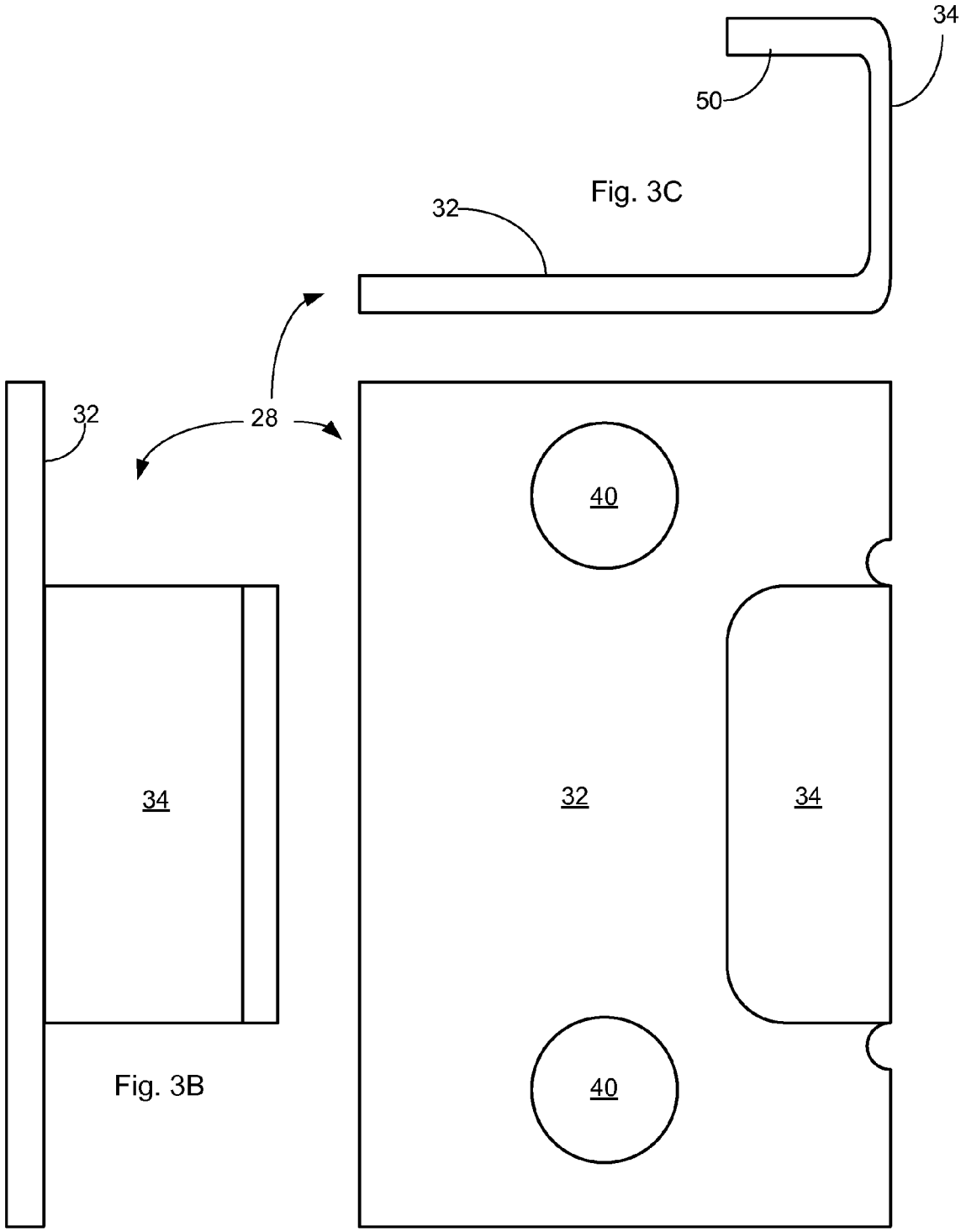
FIG. 3A is a top view of the frame mount of the snubber system shown in FIG. 2.
FIG. 3B is a first side view of the frame mount of the snubber system shown in FIG. 2.
FIG. 3C is a second side view of the frame mount of the snubber system shown in FIG. 2.
Figures 4A, 4B, 4C:
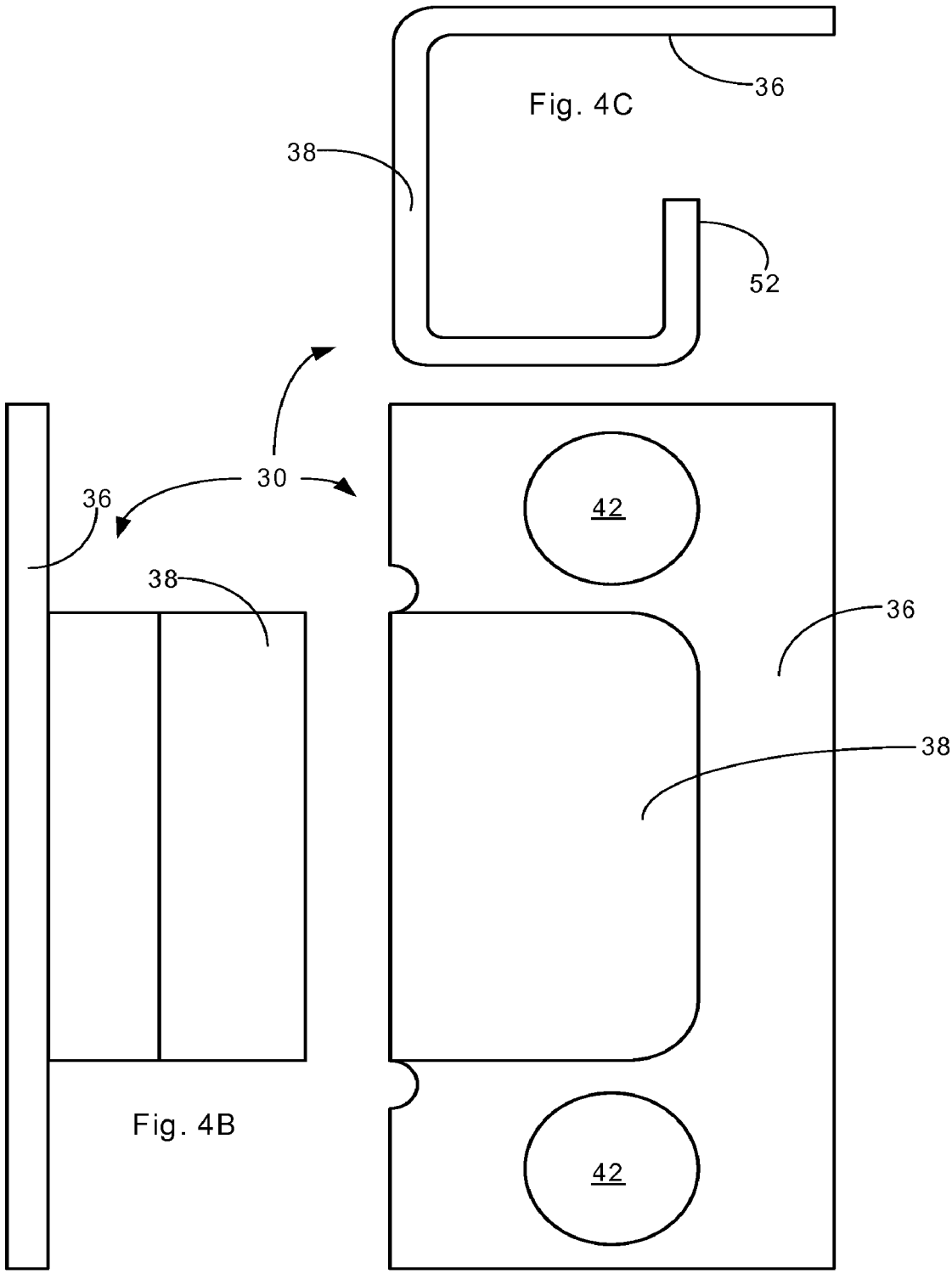
FIG. 4A is a top view of a sash mount of the snubber system shown in FIG. 2.
FIG. 4B is a first side view of the sash mount of the snubber system shown in FIG. 2.
FIG. 4C is a second side view of the sash mount of the snubber system shown in FIG. 2.

As shown in FIGS. 3A-3C, the frame mount 28 includes a straight segment 32 for securing to the frame member 24 and a folded segment 34. As shown in FIGS. 4A-4C, the sash mount 30 includes a straight segment 36 for securing to the sash member 22 and a folded segment 38. When mounted on the window unit 10, with the window sash 18 closed, the frame mount 28 and the sash mount 20 are vertically aligned and their respective folded segments 34 and 38 overlap as shown in FIG. 2. In order to pivot open the window sash 18, a user needs to lift the window sash 18 by an amount such that the frame mount 28 and the sash mount 30 are no longer vertically aligned. The frame mount 28 and the sash mount 30 can be of any suitable shape including cooperating or interlocking shapes such as those shown in FIGS. 3A-3C and FIGS. 4A-4C.

When the frame mount 28 and the sash mount are vertically aligned as shown in FIG. 1, the window unit 10 is able to sustain higher wind forces than in the absence of the snubber system 12.

Although the snubber system 12 is shown installed to a pivotable window sash 18, it can also be installed to horizontal, pivotable slider windows or to non-pivotable windows to provide additional structural strength to the windows. The snubber system 12 can also be installed on sliding window-door units (not shown).

FIG. 3A shows a top view of the frame mount 28, which can include one or more apertures or holes 40 for receiving screws (not shown) for securing the frame mount 28 to the frame member 24. FIG. 3B is a first side view of the frame mount 28 and FIG. 3C is an end view of the frame mount 28.

FIG. 4A shows a top view of the sash mount 30, which can include one or more apertures or holes 42 for receiving screws (not shown) for securing the sash mount 30 to the sash member 22. FIG. 4B is a first side view of the sash mount 30 and FIG. 4C is an end view of the sash mount 30.

In FIGS. 3C and 4C, the frame mount 28 and the sash mount 30 are shown with folded segments 34 and 38 respectively. The folded segments 34 and 38 themselves are shown having respective hook segments 50 and 52, the hook segment 50 and 52 providing interlocking or cooperating capability to the frame mount 28 and the sash mount 30. The hook segments 50 and 52 are for abutting against each to prevent, for example, in the case of hung windows, horizontal movement of the sash member 22 with respect to the frame member 24, under strong winds. This is particularly important in the case of PVC window units, subject to substantial bending in strong winds, installed in geographical regions prone to hurricanes. In cases where the window unit frame is made of a relatively rigid material, the hook segments 50 and 52 need not be present.

FIG. 1 shows a window unit 10 having two snubber systems 12 installed on the window sash 18. As will be understood by a worker skilled in the art, any number of snubber systems 12 can be installed on the window sash 18. FIGS. 3A and 4A respectively show the frame mount 28 and the sash mount 30 each having two holes 40 and 42 for the installation of the mounts to the window unit. As will be understood by a worker skilled in the art, any number of holes 40 and 42 can be used, including no holes at all.

The sash mount 28 and the frame mount 30 can be made of any suitable material such as, for example, stainless steel or impact resistant plastic. The frame member 24 and the sash member can also be made of any suitable material including, but not limited to, wood, aluminum and PVC.

Figure 5:
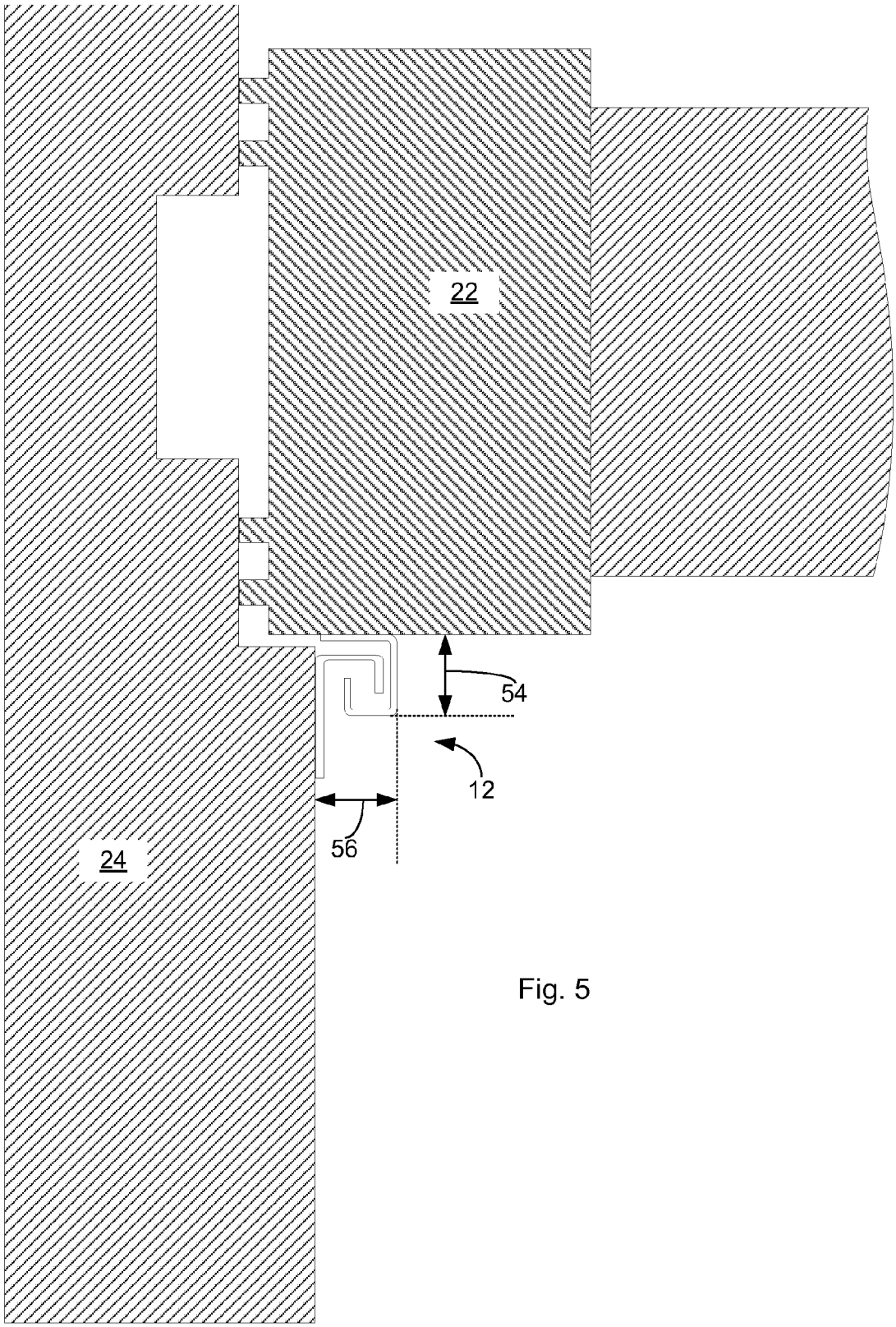
FIG. 5 is the cross-sectional view of FIG. 2 with indications regarding the dimensions of the snubber system embodiment of FIG. 2.

Normal use of the window sash 18 dictates that the profile of the snubber system 12 allow the window sash 18 to be lifted without catching the frame of the fixed window 16. The snubber system 12 can be constructed such that its profile has this characteristic. The profile is characterized by frame mount length 54 and by sash mount length 56 shown in FIG. 5. Such a snubber system 12 allows for a full amplitude of movement of the window sash 18, i.e., the window sash 18 can be lifted to its full open position the same as if there was no snubber system 12 installed. Further, when a window unit is a double hung window unit such as shown in FIG. 6, the snubber system 12 profile allows for full amplitude of movement of both window sashes 18 and 62.

Figure 6:
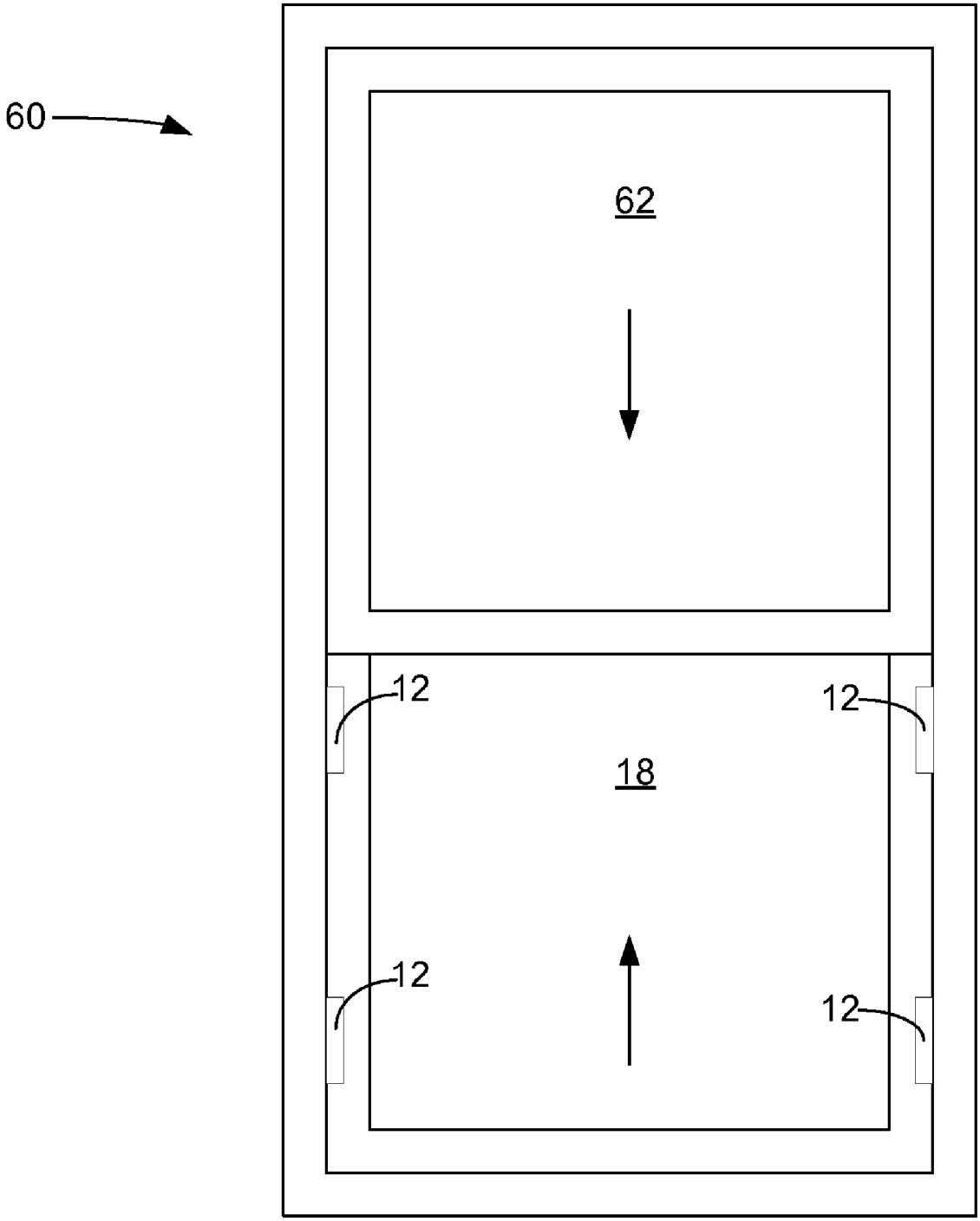
FIG. 6 is a frontal view of a double hung window unit having a lower window sash equipped with four snubber systems of an embodiment of the present invention.

FIG. 6 shows a double hung window unit 60 where the fixed window 16 shown in FIG. 1 is now a window sash 62. The window unit 60 is shown with four snubber systems 12 installed on the sash window 18. Snubber systems 12 can also be installed to the upper window sash 62. However, as will be understood by a worker skilled in the art,, there is little need for a snubber system 12 on the upper window sash 62 as long as the window unit 60 includes an interior transverse frame member (not shown) against which the upper part of the window sash 62 abuts when in a closed position. Nonetheless, snubbers systems 12 can be installed to the upper window sash to provide additional structural strength.

The same conditions regarding the profile of the snubber system 12 installed on a single hung window unit 10 also apply to a double hung window unit 60.

The advantages of the snubber system of the present invention over the prior art are that, unlike snubber systems such as Wang's, the frame mount and the sash mount are installed to accessible parts of the window unit, not on hidden parts of the window frame and sash. Additionally, the snubber system of the present invention can easily be retrofitted to existing windows regardless of the thickness or profile of the sash member. The snubber system of the present invention is also advantageous over the system of Hapka in that the retrofitting of the snubber system of the present invention does not require any delicate removal of portions of the window frame.

Therefore, the present invention provides a snubber system for securing windows subjected to strong winds. The snubber system includes two easy-to-install cooperating parts that can be retrofitted to most existing window units. The snubber system includes a frame mount secured to the window frame and a sash mount secured to a sash of the window unit on a part of the sash facing the outside of the building receiving the window unit. The frame mount and sash mount abut when the window unit is in a closed position and when pressure is applied to the sash window.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A window unit comprising:

a frame having an exposed frame surface;

a sash having an exposed sash surface substantially perpendicular to the exposed frame surface, the sash being movable along a displacement direction between an open position and a closed position and pivotable about a pivot axis, the sash having a window pane; and a snubber system comprising a sash mountable part and a frame mountable part, the sash mountable part being securely fixed to the sash on the exposed sash surface, the frame mountable part being securely fixed to the frame on the exposed frame surface, the sash mountable part and the frame mountable part being mounted substantially perpendicularly to each other, the sash mountable part and the frame mountable part being adapted to engage each other when the sash is in the closed position and a pressure is applied to the sash, the engagement of the sash mountable part and frame mountable part preventing the sash from pivoting, the sash mountable part defines a channel extending substantially parallel to the displacement direction, the frame mountable part has a projection extending away from the frame in a direction substantially parallel to the window pane and into the channel, the sash mountable part includes a flat section, the flat section abutting the exposed sash surface and being fixedly secured to the sash, the sash mountable part has a channel wall overhanging the flat section of the sash mountable part, the projection of the frame mountable part abutting the channel wall when the sash is in the closed position and said pressure is applied to the sash, wherein the channel wall has a first protrusion extending towards the sash, and the projection of the frame mountable part has a second protrusion extending towards the channel wall, the second protrusion overhanging at least partly the first protrusion when the sash is in the closed position, the first protrusion being located between the second protrusion and the exposed frame surface to which the frame mountable part is securely fixed, the second protrusion and the first protrusion abutting each other when the sash is in the closed position and the sash is bent by the pressure applied to the sash.

2. The window unit of claim 1 wherein the flat section of the sash mountable part defines a hole, the hole receiving a fastener fastening the sash mountable part to the sash.

3. The window unit of claim 1 wherein the frame mountable part includes a flat section, the flat section of the frame mountable part abutting the exposed frame surface and being fixedly secured to the frame.

4. The window unit of claim 3 wherein the flat section of the frame mountable part defines a hole which receives a fastener fastening the frame mountable part to the frame.

* * * * *